US008515328B2

(12) United States Patent
Aoki

(10) Patent No.: US 8,515,328 B2
(45) Date of Patent: Aug. 20, 2013

(54) MEDIUM CONVEYING APPARATUS AND IMAGE FORMING APPARATUS

(75) Inventor: Hiroyuki Aoki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 635 days.

(21) Appl. No.: 12/540,841

(22) Filed: Aug. 13, 2009

(65) Prior Publication Data

US 2010/0243697 A1 Sep. 30, 2010

(30) Foreign Application Priority Data

Mar. 26, 2009 (JP) ..... P2009-076024

(51) Int. Cl.
*G03G 15/00* (2006.01)

(52) U.S. Cl.
USPC ..... 399/384; 399/388; 399/395; 101/485; 101/486; 226/15; 226/20

(58) Field of Classification Search
USPC ..... 399/384, 388, 395; 101/92, 485, 101/486, DIG. 42, 481; 250/548; 226/15, 226/2, 20, 16, 27, 24
See application file for complete search history.

(56) References Cited

U.S. PATENT DOCUMENTS

| | | | | |
|---|---|---|---|---|
| 5,887,125 | A | 3/1999 | Takano et al. | |
| 6,622,621 | B2 * | 9/2003 | Bucher et al. | 101/228 |
| 8,185,036 | B2 | 5/2012 | Aoki | |
| 2002/0096069 | A1 | 7/2002 | Bucher et al. | |
| 2006/0062617 | A1 * | 3/2006 | Yamasaki | 399/384 |

FOREIGN PATENT DOCUMENTS

| | | |
|---|---|---|
| JP | 7-009728 | 1/1995 |
| JP | 09-240121 | 9/1997 |
| JP | 9-272230 | 10/1997 |
| JP | 2002-127371 A | 5/2002 |
| JP | 2005-266121 | 9/2005 |
| JP | 2006-91184 A | 4/2006 |
| JP | 2007-171862 | 7/2007 |

OTHER PUBLICATIONS

Office Action from the Japanese Patent Office dated Apr. 26, 2013 in counterpart Japanese application No. 2009-076024. Note: Partial translation.

* cited by examiner

*Primary Examiner* — Matthew G Marini
(74) *Attorney, Agent, or Firm* — Morgan, Lewis & Bockius LLP

(57) ABSTRACT

A medium conveying apparatus includes: a conveying mechanism that conveys a recording medium that extends long continuously in one direction, a conveying direction of the recording medium being the same as the one direction; a detecting unit that detects a detection subject mark formed on the recording medium; and a moving mechanism that moves the detecting unit in a direction that crosses the conveying direction, and a plurality of detection subject marks are formed on the recording medium in such a manner that they are arranged in the direction in which the recording medium extends long continuously and that a mark width in the direction that crosses the conveying direction changes as the position goes along the conveying direction.

9 Claims, 11 Drawing Sheets

MEDIUM CONVEYING APPARATUS AND IMAGE FORMING APPARATUS

CROSS-REFERENCE TO RELATED APPLICATIONS

This application is based on and claims priority under 35 USC 119 from Japanese Patent Application No. 2009-076024 filed on Mar. 26, 2009.

BACKGROUND

1. Technical Field

The present invention relates to a medium conveying apparatus and an image forming apparatus.

2. Related Art

Among image forming apparatus are ones which form images on a sheet (hereinafter also referred to as "continuous form") that extends long continuously in one direction (e.g., in the auxiliary direction of image formation). Continuous forms are classified into two types, that is, a type in which plural feed holes are arranged in the longitudinal direction and a type (what is called a pinless type) having no feed holes.

In such image forming apparatus, it is common that print positions on a continuous form are adjusted by using registration marks.

SUMMARY

According to an aspect of the invention, there is provided a medium conveying apparatus including: a conveying mechanism that conveys a recording medium that extends continuously in one direction, a conveying direction of the recording medium being the same as the one direction; a detecting unit that detects a detection subject mark formed on the recording medium; and a moving mechanism that moves the detecting unit in a main scanning direction that crosses the conveying direction, wherein a plurality of detection subject marks are formed on the recording medium in such a manner that they are arranged in the one direction in which the recording medium extends continuously and that a mark width in the main scanning direction changes as the position goes along the conveying direction.

BRIEF DESCRIPTION OF THE DRAWINGS

Exemplary embodiments of the present invention will be described in detail based on the following figures, wherein.

DESCRIPTION OF SYMBOLS

1, 1*a*, 1*b* . . . Image forming apparatus; 11 . . . Conveying path; 12 . . . Mark detecting unit; 12*a* . . . Sensor unit; 12*b* . . . Rail; 12*c* . . . Drive motor; 12*d* . . . Drive belt; 13 . . . Transfer unit; 14 . . . Fusing unit; 15 . . . Control printed circuit board; B . . . Beam spot; L . . . Slant line; M . . . Mark; P . . . Continuous form

DETAILED DESCRIPTION

A medium conveying apparatus and an image forming apparatus according to the present invention will be hereinafter described with reference to the drawings.

First, the image forming apparatus according to an exemplary embodiment of the invention will be described.

The image forming apparatus that will be described below serves to form images on a continuous form (connected document forms) which extends long continuously in one direction.

The "one direction" is typically the auxiliary scanning direction of image formation on a continuous form. In this case, in the image forming apparatus, a continuous form that extends long continuously in the auxiliary scanning direction of image formation is used as a recording medium on which images are to be formed and is conveyed in its longitudinal direction, that is, in the direction in which it extends long continuously. In other words, the continuous form conveying direction coincides with the auxiliary scanning direction of image formation on a continuous form.

This means that the main scanning direction which is perpendicular to the auxiliary scanning direction coincides with the direction that is perpendicular to the continuous form conveying direction. The term "direction that is perpendicular to the continuous form conveying direction" is an example of a direction that crosses the conveying direction.

The continuous form may be either of a type in which plural feed holes are formed at both end portions in the width direction (i.e., at both side end portions) so as to be arranged in the longitudinal direction and a type having no feed holes. A continuous form with feed holes is conveyed by engaging tractor pins with the feed holes. A continuous form having no feed holes is conveyed by holding it between rollers.

Figure 1:
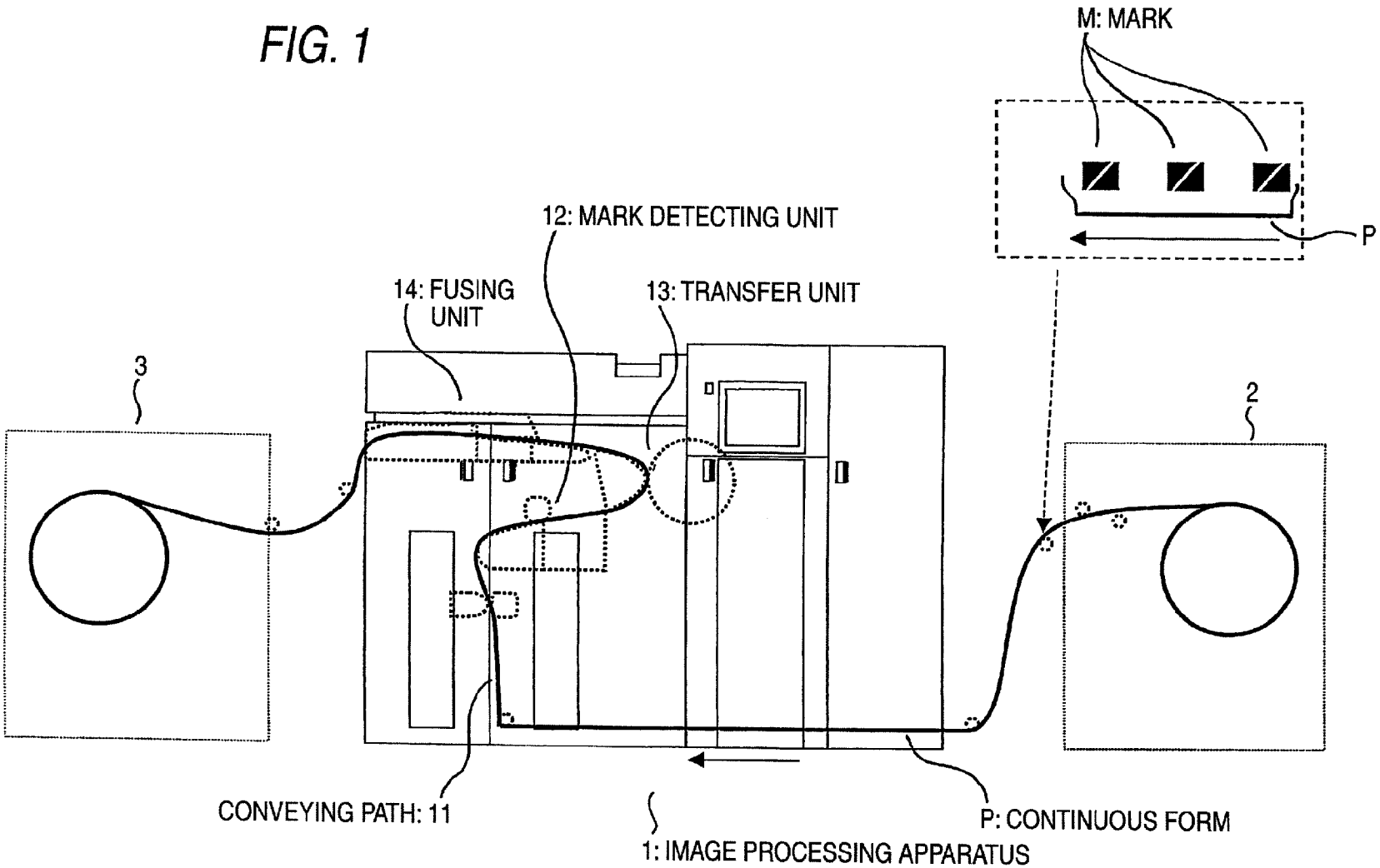
FIG. 1 illustrates an example configuration of a system including a single image forming apparatus for forming images on a continuous form.

FIG. 1 illustrates an example configuration of a system including an image forming apparatus for forming images on a continuous form, more specifically, a continuous form printing system with a single image forming apparatus.

The continuous form printing system of FIG. 1 is equipped with a preprocessing apparatus 2 and a post-processing apparatus 3 as well as an image forming apparatus 1.

The preprocessing apparatus 2 is to pay out a continuous form P that is housed therein in roll form. It is assumed that preprint marks (hereinafter referred to simply as "marks") M as detection subject marks are formed on the continuous form P that is paid out by the preprocessing apparatus 2 at preset positions on the continuous form P (more specifically, in image formation prohibition areas), that is, at preset intervals in the longitudinal direction (e.g., at such intervals that one to several marks M are located on each page). The marks M have a preset shape and function as registration marks that are used for registration when images are formed on the continuous form P.

On the other hand, the post-processing apparatus 3 is to take up and house the continuous form P that has been processed by the image forming apparatus 1.

The image forming apparatus 1, which is disposed between the preprocessing apparatus 2 and the post-processing apparatus 3, is equipped with, along a conveying path 11 for conveyance of the continuous form P in its longitudinal direction (the auxiliary scanning direction of image formation), a mark detecting unit 12 for detecting a mark M formed on the continuous form P, a transfer unit 13 for transferring an image onto the continuous form P, and a fusing unit 14 for fusing the image transferred onto the continuous form P. The transfer unit 13 and the fusing unit 14 will not be described in detail because they employ a known electrophotographic technology.

In the continuous form printing system having the above configuration, before image transfer by the transfer unit 13, a mark M formed on the continuous form P in advance is detected by the mark detecting unit 12 and position information in the conveying direction (auxiliary scanning direction) is recognized. The recognition result is reflected in determining an image transfer start position in the transfer unit 13. As a result, a write start position of an image on the continuous form P can be set at a prescribed position on the continuous form P that is prescribed by the mark M.

Figure 2:
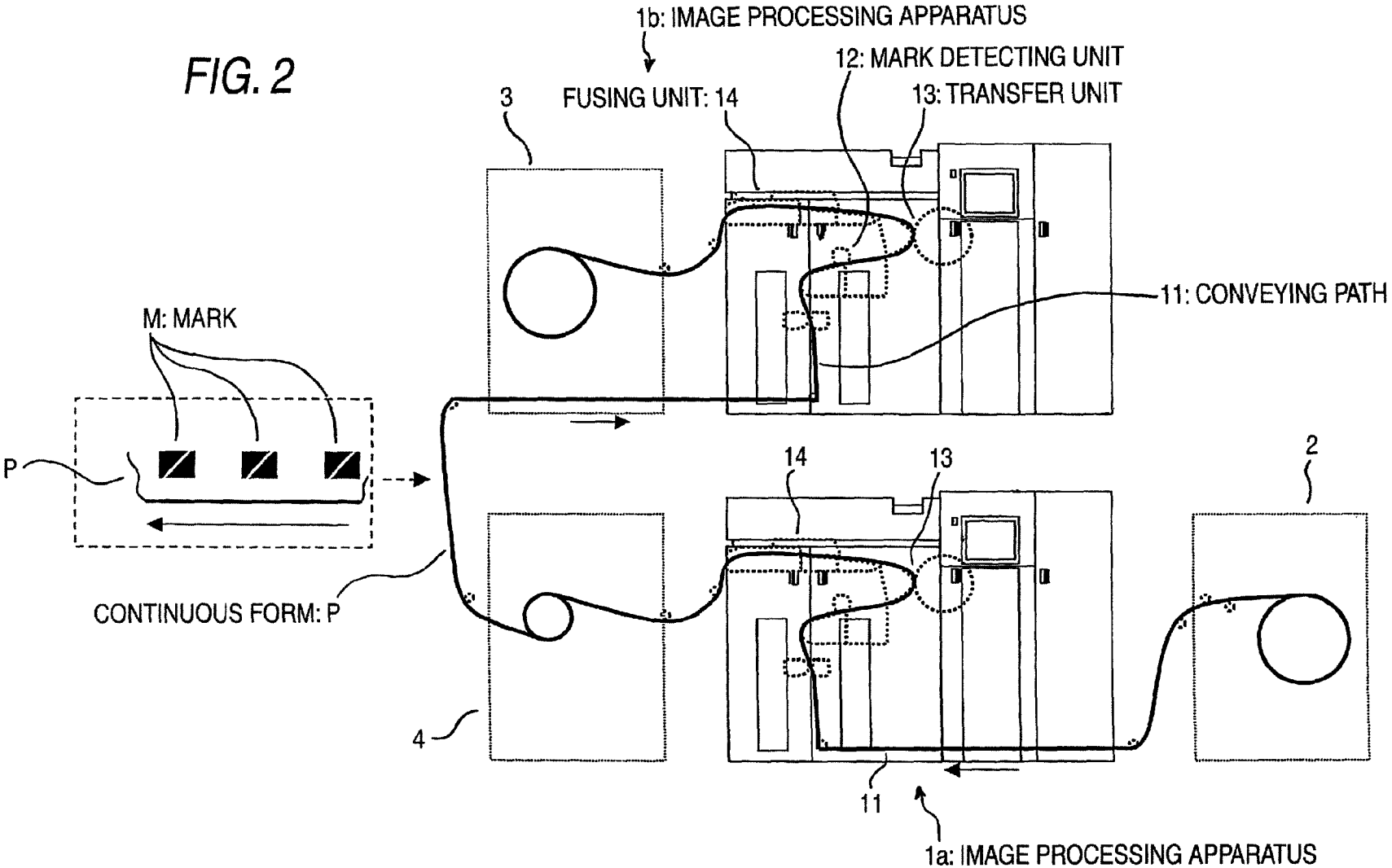
FIG. 2 illustrates an example configuration of another system including cascade image forming apparatus for forming images on a continuous form.

FIG. 2 illustrates an example configuration of a system including image forming apparatus for forming images on a continuous form, more specifically, a continuous form printing system with cascade image forming apparatus.

In the continuous form printing system of FIG. 2, a first image forming apparatus 1*a* and a second image forming apparatus 1*b* are disposed between a preprocessing apparatus 2 and a post-processing apparatus 3 and an inverting apparatus 4 for inverting a continuous form P is disposed between the first and second image forming apparatus 1*a* and 1*b*.

In the continuous form printing system having the above configuration, an image is formed on one surface of a continuous form P and a registration mark (hereinafter referred to simply as "mark") as a detection subject mark is formed at a prescribed position on the continuous form P (more specifically, in an image formation prohibition area) by the first image forming apparatus 1*a*. Then, in the second image forming apparatus 1*b*, an image is formed on the other surface of the continuous form P. Before image transfer by a transfer unit 13, the mark M formed on the continuous form P is detected by a mark detecting unit 12 and position information in the conveying direction (auxiliary scanning direction) is recognized. The recognition result is reflected in determining an image transfer start position on the other surface in the transfer unit 13. As a result, write start positions of images on both surfaces of the continuous form P can be set correctly with respect to each other.

Next, a description will be made of an example configuration of an important part of the image forming apparatus 1 or 1*b* which is used in the above-described continuous form printing system with a single or cascade image forming apparatus, that is, an example configuration of a medium conveying apparatus according to an exemplary embodiment of the invention.

As described above, in the image forming apparatus 1 or 1*b*, the mark detecting unit 12 for detecting a mark M formed on a continuous form P is disposed on the conveying path 11 for conveyance of the continuous form P (which extends long continuously in the auxiliary scanning direction of image formation) in the auxiliary direction.

Figure 3B:
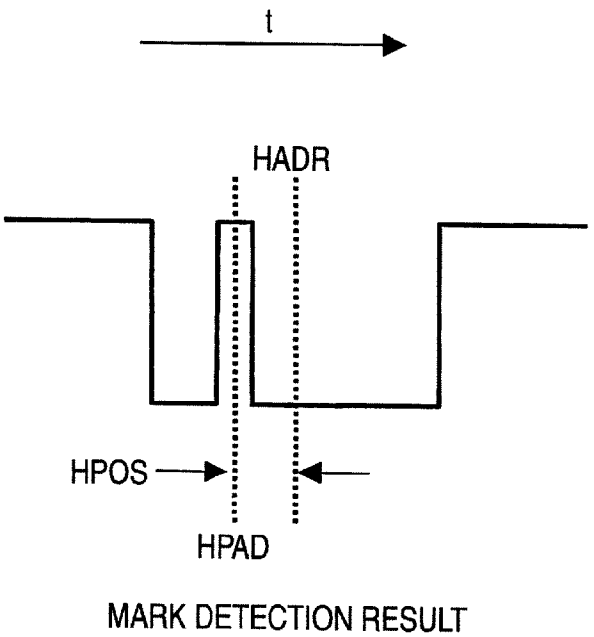
FIGS. 3A and 3B illustrate a specific example of a detection subject mark formed on a continuous form.
Figure 3A:
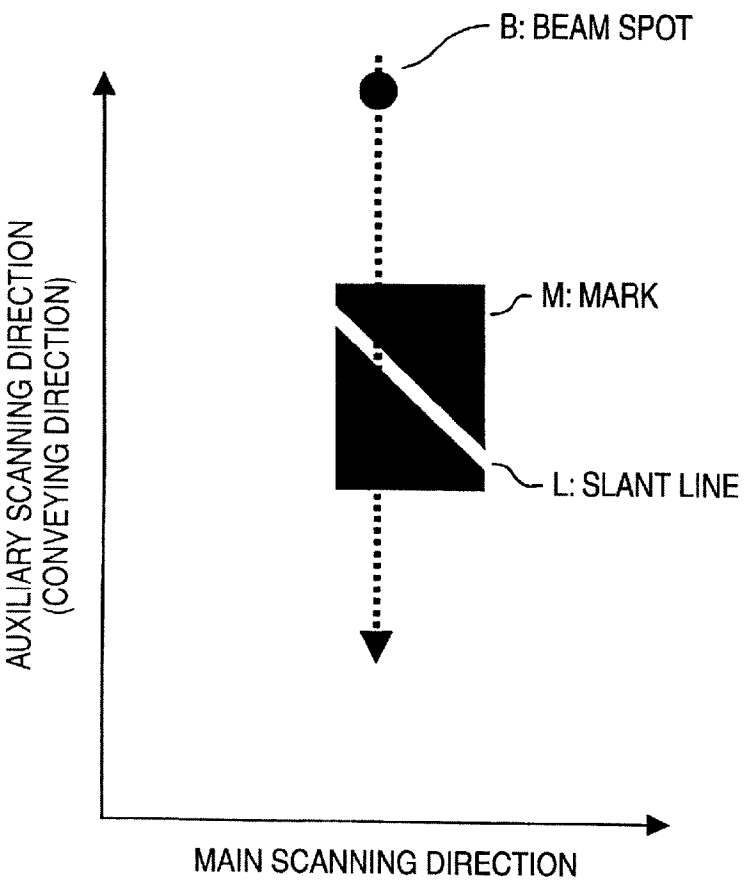

FIGS. 3A and 3*b* illustrate a specific example of a detection subject mark formed on a continuous form.

FIG. 3A shows a mark M formed on a continuous form P and having a rectangular shape including a slant line L. The mark detecting unit 12 detects such a mark M. The detection is performed typically by an optical sensor. It is assumed that in the mark detecting unit 12 the optical sensor is disposed, in the main scanning direction, at such a position as to be able to read a mark M being conveyed, that is, at such a position that its effective detection range overlaps with the range of formation of the mark M in the main scanning direction.

The mark detecting unit 12 detects a mark M on a continuous form P using an effective detection range that is smaller than the size of the mark M in the main scanning direction (hereinafter referred to simply as "mark width"). More specifically, for example, light is applied so that a beam spot B is formed whose diameter is smaller than the mark width in the main scanning direction (i.e., in the direction perpendicular to the conveying direction) of the mark M on the continuous form P, and the mark M is detected with an optical sensor whose effective detection range is the illumination range of the beam spot B. The optical sensor may be either of a reflection type and a transmission type. However, the sensor is not limited to the optical sensor, and another known sensor may be used as long as its effective detection range is smaller than the size of the mark M in the main scanning direction.

Upon reading a mark M, the optical sensor of the mark detecting unit 12 outputs a signal having, for example, a waveform as shown in FIG. 3B.

Signal processing described below is performed on the output signal of the optical sensor of the mark detecting unit 12.

For example, when the signal having the waveform as shown in FIG. 3B is output, a center position HADR in the auxiliary scanning direction of the mark M thus read is calculated from pieces of edge information (rising edge information and trailing edge information) of the signal. And a center position HPAD in the auxiliary scanning direction of the slant line L is calculated from pieces of edge information (rising edge information and trailing edge information) of the slant line L. Then, a deviation HPOS between center positions in the main scanning direction of the effective detection range of the optical sensor and the mark M read by the optical sensor of the mark detecting unit 12 is determined by using the above calculation results and a preset calculation formula $HPOS=\alpha(HADR-HPAD)$, where $\alpha$ is a coefficient that is determined from the inclination angle of the slant line L and serves to convert a relative positional relationship in the auxiliary scanning direction into a relative positional relationship in the main scanning direction.

In the above-described manner, the deviation HPOS between the center positions in the main scanning direction of the effective detection range of the optical sensor of the mark detecting nit 12 and the mark M read by the optical sensor is determined as a relative positional relationship between the effective detection range of the optical sensor and the mark M.

As described above, each mark M as a detection subject should include a shape portion that makes it possible to uniquely determine a relative positional relationship in the main scanning direction between the mark M and the beam spot from detection timing of the shape portion, such as the slant line L shown in FIG. 3A.

Figure 4B:
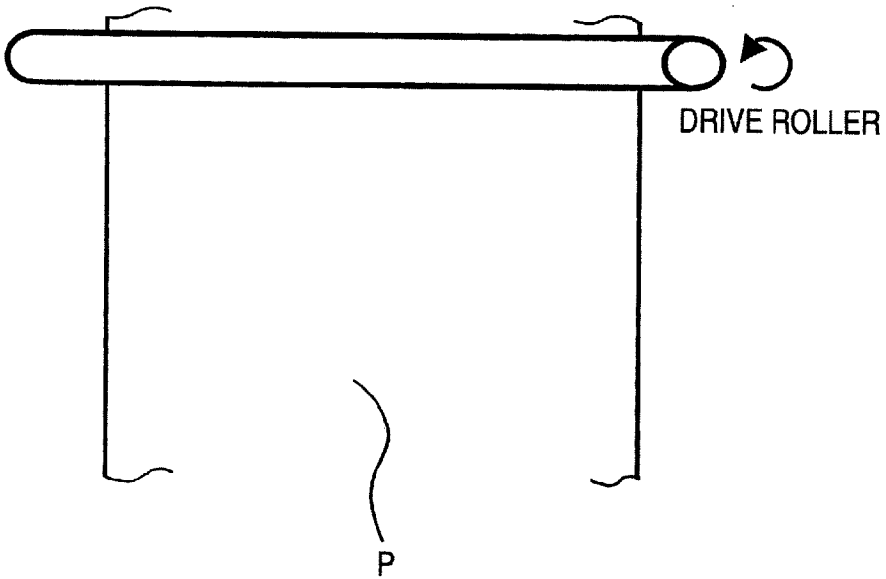
FIGS. 4A and 4B illustrate specific examples of a mechanism for conveying a continuous form.
Figure 4A:
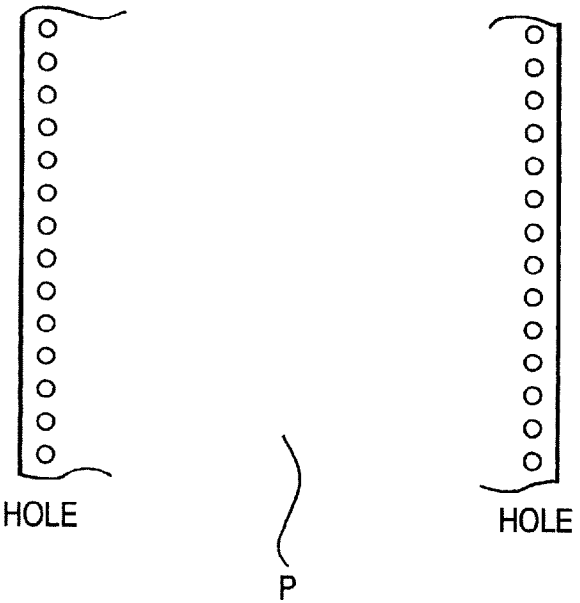

FIGS. 4A and 4B illustrate specific examples of a mechanism for conveying a continuous form.

For example, FIG. 4A shows a mechanism for conveying a continuous form P in which plural feed holes are formed at both end portions in the width direction (i.e., at both side end portions) of the continuous form P so as to be arranged in the longitudinal direction and tractor pins are engaged with the feed holes, whereby the continuous form P is conveyed while being pressed. With this mechanism, only small erratic action occurs in the continuous form P both in a start period of conveyance and during continuous conveyance.

FIG. 4B shows a mechanism for pinless conveyance of a continuous form P. In the pinless conveyance, a drive roller conveys the continuous form P while pulling it. Therefore, erratic action of the continuous form P tends to be large particularly in a start period of conveyance when the conveyance is unstable.

Figure 5:
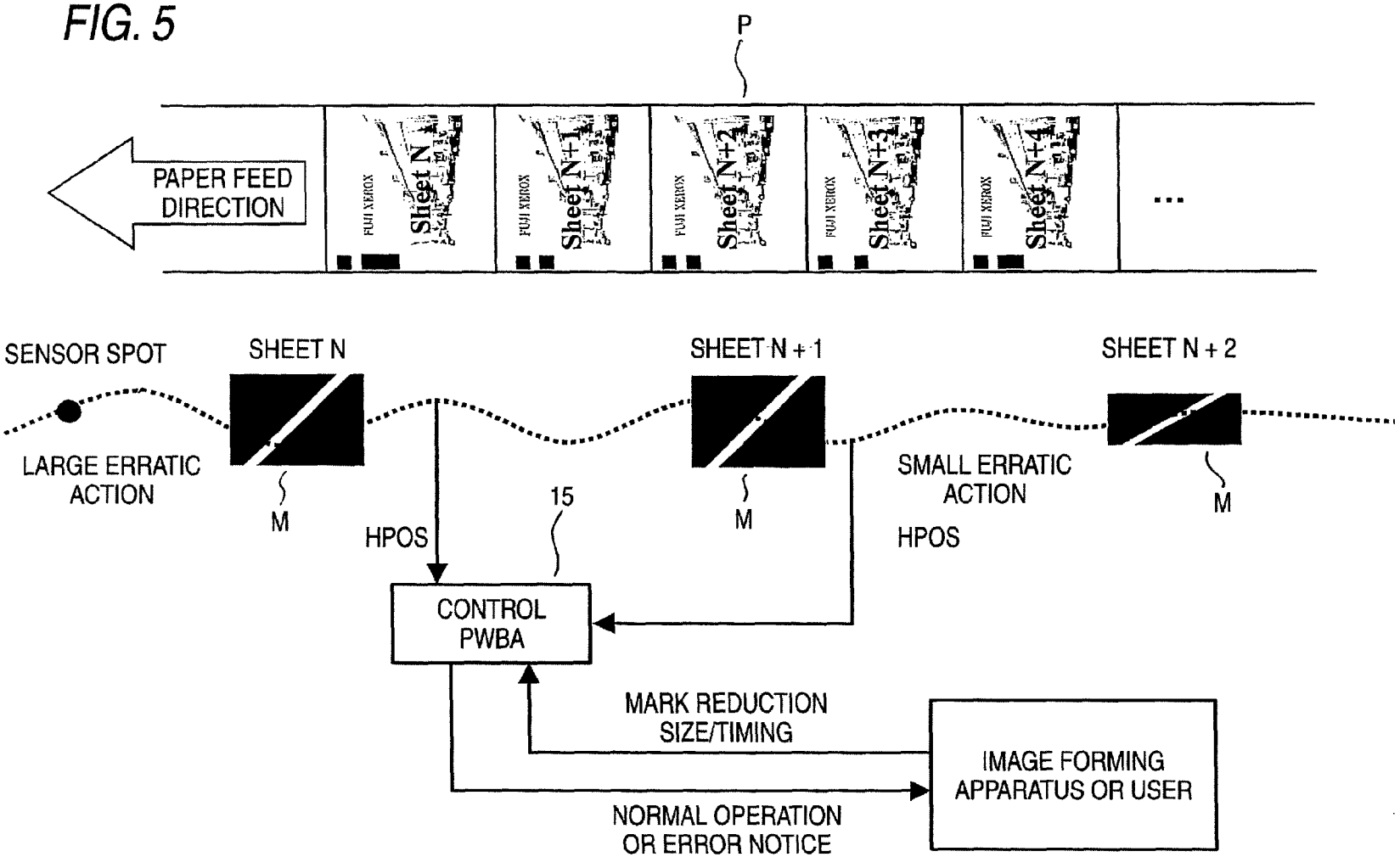
FIG. 5 illustrates an example configuration of an important part of the image forming apparatus according to the invention.

FIG. 5 illustrates an example configuration of an important part of the image forming apparatus 1 or 1*b*.

As shown in FIG. 5, a control printed circuit board (or control printed wiring board assembly (PWBA)) 15 is electrically connected to the mark detecting unit 12 for detecting a mark M. The control printed circuit board 15 receives a signal indicating a detection result of a mark M from the mark detecting unit 12 and performs the above-described signal processing thereon, and determines a relative positional relationship between the effective detection range of the optical sensor of the mark detecting unit 12 and the mark M detected by the optical sensor from a result of the signal processing. As such, the control printed circuit board 15 functions as a positional relationship determining section for determining such a relative positional relationship. Furthermore, as described later, the control printed circuit board 15 judges whether mark width change of the mark M should be permitted and, if mark width change should be permitted, outputs information to that effect. That is, the control printed circuit board 15 functions as a control section for outputting information relating to mark width change of the mark M.

The control printed circuit board 15 is typically implemented as a combination of a CPU (central processing unit) which runs a prescribed program, a storage device for storing the prescribed program, and other components. In this case, the control printed circuit board 15 is implemented by utilizing functions of a computer.

The medium conveying apparatus according to an exemplary embodiment of the invention is obtained by removing the components for image formation such as the transfer unit 13 and the fusing unit 14 from the image forming apparatus 1 or 1*b* whose important part has the above configuration.

Next, a description will be made of an example operation of the image forming apparatus 1 or 1*b* (medium conveying apparatus) having the above configuration.

In the image forming apparatus 1 or 1*b* (medium conveying apparatus), a continuous form P is conveyed along the conveying path 11 at a speed of 1 m/s or higher. Plural marks M are formed on the continuous form P at preset intervals in the longitudinal direction (i.e., in the direction in which the continuous form P extends long continuously). Therefore, as the continuous form P is conveyed, the optical sensor of the mark detecting unit 12 detects the marks M sequentially.

Upon receiving a signal indicating a result of reading of each mark M by the optical sensor of the mark detecting unit 12, the control printed circuit board 15 performs signal processing on the received signal and determines a relative positional relationship between the effective detection range of the optical sensor and the mark M from a result of the signal processing. When a preset, fixed number (hereinafter referred to as "specified number") of marks M have been detected consecutively and relative positional relationships have been determined, the control printed circuit board 15 judges whether mark width change of the mark M should be permitted. More specifically, the control printed circuit board 15 allows mark shape change of the mark M, that is, reduction of the width of the mark M, on condition that the detected relative positional relationships satisfy a preset criterion.

Figure 6:
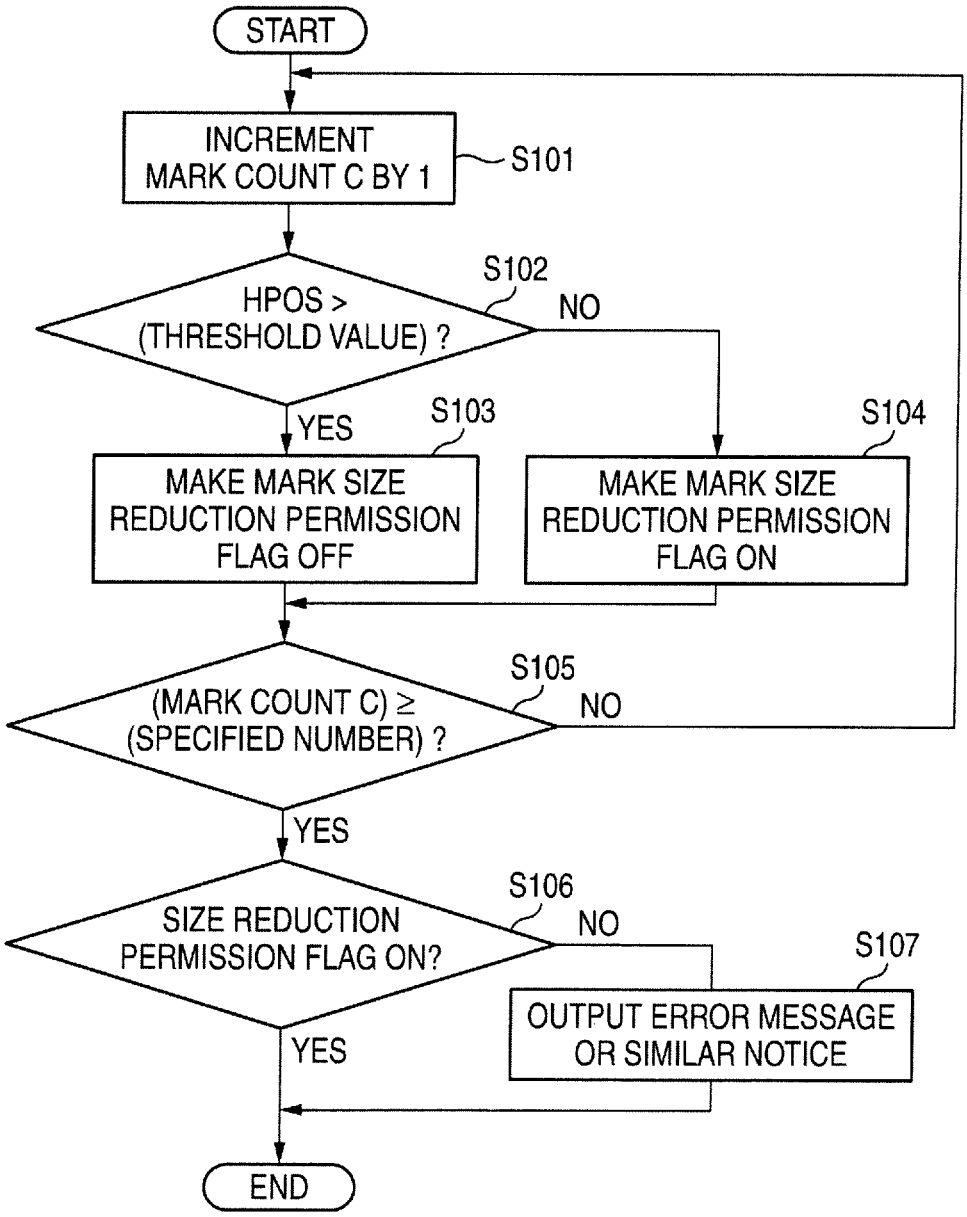
FIG. 6 is a flowchart of a specific example of a control process of the image forming apparatus according to the invention.

FIG. 6 is a flowchart of a specific example of a control process of the image forming apparatus according to an exemplary embodiment of the invention.

As shown in FIG. 6, upon receiving a mark detection signal from the mark detecting unit 12, at step S101 the control printed circuit board 15 starts counting the number of marks M.

Every time a detection signal is received from the mark detecting unit 12, the control printed circuit board 15 performs signal processing on the detection signal and determines a deviation HPOS between center positions in the main scanning direction of the effective detection range of the optical sensor of the mark detecting unit 12 and the mark M detected by the optical sensor. Upon determining a deviation HPOS, at step S102 the control printed circuit board 15 compares the determined deviation HPOS with a preset threshold value and judges whether the deviation HPOS is larger than the threshold value. If HPOS>(threshold value), at step S103 the control printed circuit board 15 makes a mark size reduction permission flag off. On the other hand, if HPOS≦(threshold value), at step S104 the control printed circuit board 15 makes the mark size reduction permission flag on.

At step S105, the control printed circuit board 15 judges whether the count C of marks M is larger than or equal to a preset number (specified number). If the count C is not larger than or equal to the specified number, the process returns to step S101. On the other hand, if the count C is larger than or equal to the specified number, the process moves to step S106.

At step S106, the control printed circuit board 15 judges whether the mark size reduction permission flag is on. If the marksize reduction permission flag is on, the process is finished. On the other hand, if the mark size reduction permission flag is off, which means that the deviation HPOS is larger than the threshold value though the count C of marks M is larger than or equal to the specified number, at step S107 the control printed circuit board 15 judges that erratic action in an initial period after the start of conveyance of the continuous form P has not yet decreased sufficiently and outputs an error message or a similar notice. The error message or similar notice is typically output by using a user interface of the image forming apparatus 1 or 1*b*.

In the image forming apparatus 1 or 1*b*, since the above-described control process is executed by the control printed circuit board 15, the control printed circuit board 15 comes to permit such shape change that the mark width decreases as marks M are detected successively (i.e., not all of the marks arranged in the direction in which the continuous form P extends long continuously have the same shape). That is, it becomes possible to employ a large mark width in the main scanning direction in a start period of conveyance of a continuous form P when large erratic action may occur in the continuous form P and to employ a small mark width in the main scanning direction after deviations HPOS in the main scanning direction of marks M detected by the optical sensor of the mark detecting unit 12 have become small. Even if such shape change of the mark M is permitted, no problem would occur in the detection of subsequent marks M by the optical sensor of the mark detecting unit 12 because the erratic action of the continuous form P would be smaller during continuous conveyance of the continuous form P than in a start period of conveyance.

Figure 7A:
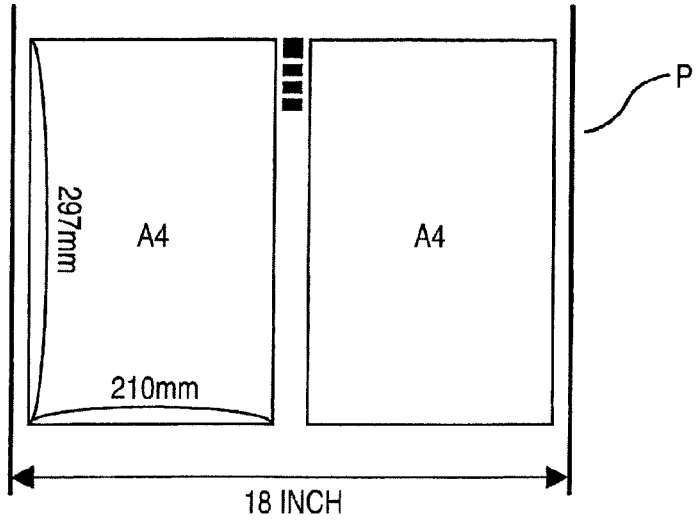
FIGS. 7A, 7B and 7C illustrate specific examples of a relationship between a continuous form and a mark size.
Figure 7B:
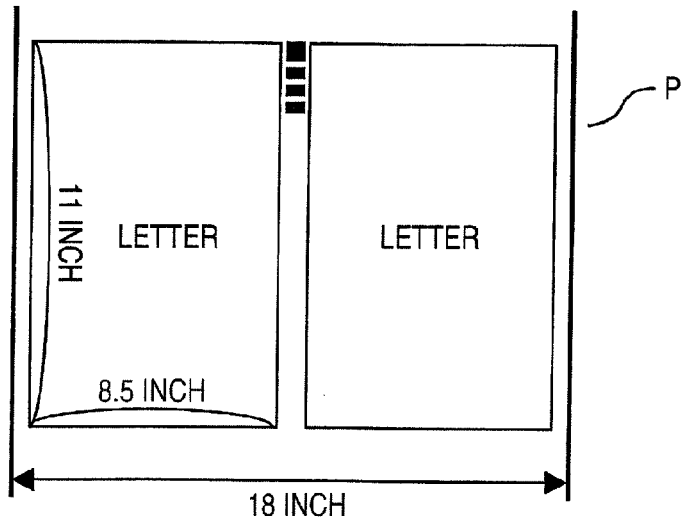
Figure 7C:
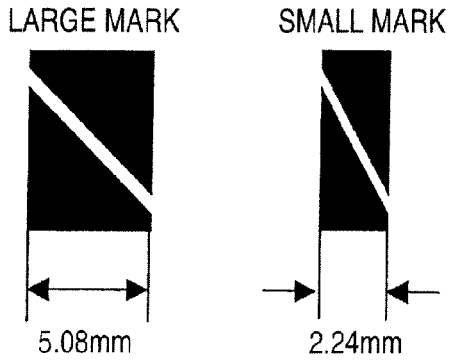

FIGS. 7A, 7B and 7C illustrate specific examples of a relationship between a continuous form and a mark size.

For example, FIG. 7A shows a case that two A-size images are to be arranged side by side in the width direction (i.e., the main scanning direction of image formation) on a continuous form P that measures 18 inches in the width direction. In this case, the total size in the width direction of blank areas on the continuous form P is calculated as 25.4 mm×18−210 mm×2=37.2 mm.

FIG. 7B show another case that two letter-size images are to be arranged side by side in the width direction on a continuous form P that measures 18 inches in the width direction. In this case, the total size in the width direction of blank areas on the continuous form P is calculated as 18 inches−8.5 inches×2=1.0 inch=25.4 mm.

FIG. 7C shows specific examples of the size of marks M formed on a continuous form P. More specifically, FIG. 7C shows a large-size mark M whose size in the width direction of the continuous form P is 5.08 mm and a small-size mark M whose size in the width direction of the continuous form P is 2.24 mm.

Where marks M of the above two kinds of sizes can be formed, in either of the cases of FIGS. 7A and 7B, blank areas left can be made wider by 10% or more when small-size marks M are formed than when large-size marks are formed.

That is, if the mark width of the plural marks M which are arranged in the direction in which the continuous form P extends long continuously is allowed to decrease as marks M are detected successively, it becomes possible to effectively utilize the area on the continuous form P by reducing the image formation prohibition areas after the behavior of the continuous form P has become stable.

The mark width of the mark M is changed while the rule relating to the marks M and used for determining a relatively positional relationship between the effective detection range of the optical sensor of the mark detecting unit 12 and a mark M is maintained. More specifically, the shape of the mark M is changed in such a manner that the dimension in the width direction (main scanning direction) of the entire rectangular shape including the slant line L which is necessary for determining a relative positional relationship is reduced without changing the inclination angle of the slant line L. Where the mark width is changed in this manner, the rule relating to the marks M is maintained as it is even after the mark width change. Therefore, the processing to be performed on a detection result of the optical sensor of the mark detecting unit 12 after mark width change need not be changed from that to be performed before the mark width change.

Incidentally, mark width change is permitted after the count C of marks M has become larger than or equal to the specified number. That is, the mark width is changed after a preset, fixed number of marks M having the same shape have passed the mark detecting unit 12 consecutively from a start of conveyance of a continuous form P. Therefore, even if errors, a variation, etc. occur in detection results of the optical sensor of the mark detecting unit 12 due to erratic action of a continuous form P in a start period of conveyance, they are prevented from affecting the subsequent processing.

Whether or not the time to judge whether shape change of the mark M should be permitted has arrived may be judged on the basis of the conveyance distance of a continuous form P from a start of conveyance rather than the count C of marks M. For example, the mark width may be changed after the conveyance distance of a continuous form P from a start of conveyance has reached a preset, fixed value.

Figure 8:
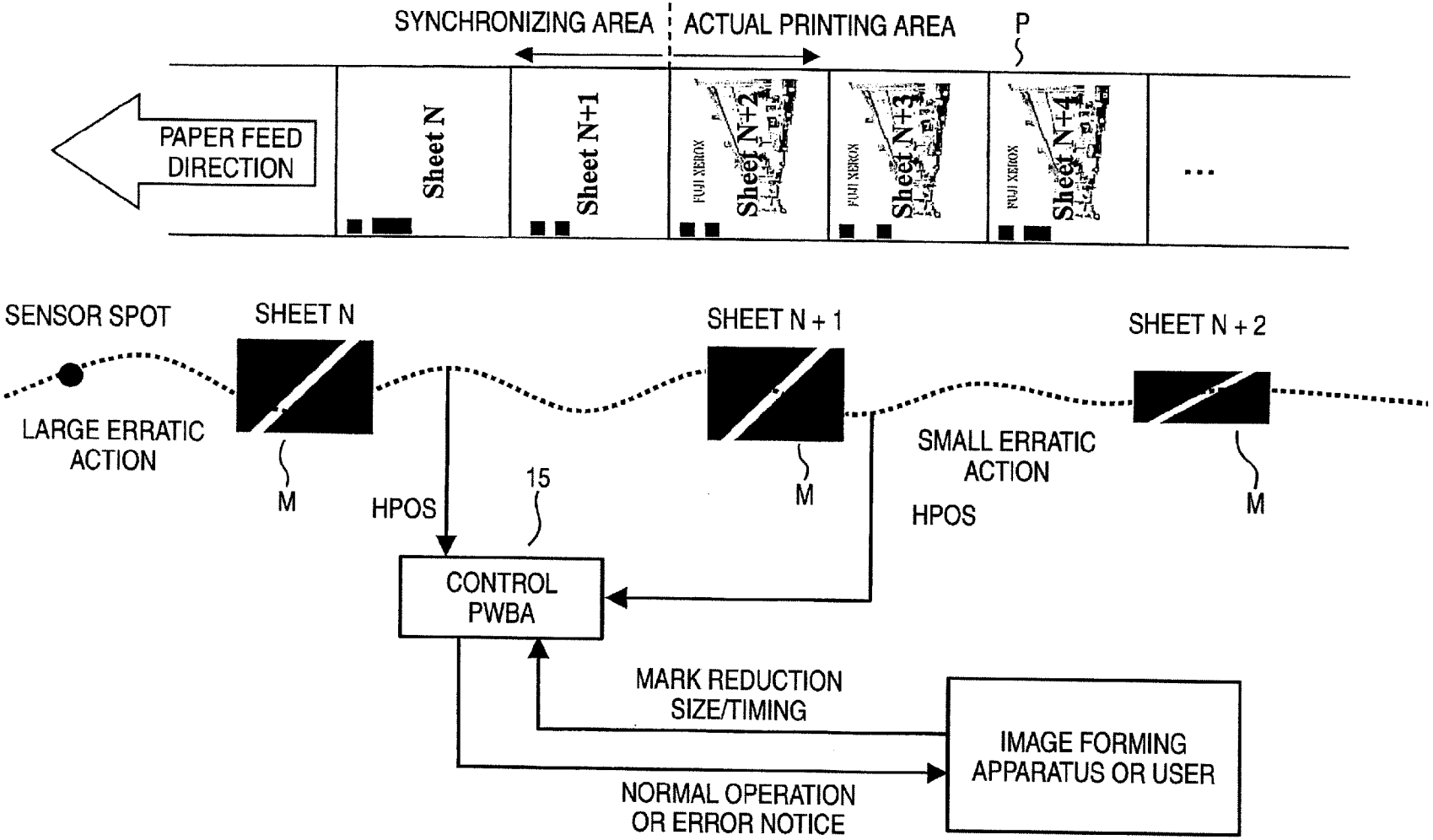
FIG. 8 illustrates another example of an important part of the image forming apparatus according to the invention.

FIG. 8 illustrates another example configuration of an important part of the image forming apparatus 1 or 1*b*.

In the example of FIG. 8, an area on a continuous form P with which the conveyance distance of the continuous form P from a start of conveyance has reached a preset, fixed value is made a "synchronizing area" and an area on the continuous form P that follows the synchronizing area is made an "actual printing area."

In the example of FIG. 8, the control printed circuit board 15 judges whether the conveyance distance (i.e., the length of that part of the continuous form P which has passed the mark detecting unit 12 from a start of conveyance has reached the fixed value, that is, whether the tail of the synchronizing area on the continuous form P has passed the mark detecting unit 12. If the tail of the synchronizing area has passed the mark detecting unit 12, the process moves to the next step (more specifically, the step of judging whether the mark size reduction permission flag is on. The other steps are the same as in the process in which the count C of marks M is employed (e.g., the process of FIG. 6).

Also in the case where the control printed circuit board 15 executes the above control process, such shape change that the mark width is reduced is permitted after the head of the actual printing area on a continuous form P has reached the mark detecting unit 12. Therefore, even if errors, a variation, etc. occur in detection results of the optical sensor of the mark detecting unit 12 due to erratic action of a continuous form P in a start period of conveyance, they are prevented from affecting the subsequent processing.

In addition, if no image formation is performed on a continuous form P until the head of the actual printing area is reached, the entire area of each page of the continuous form P can be used as part of the synchronizing area. That is, in the synchronizing area, it is not necessary to discriminate between image formation areas and image formation prohibition areas.

The mark width of the mark M may be changed in the following manner.

For example, in the continuous form printing system of FIG. 1, marks M are formed on a continuous form P that is housed in the preprocessing apparatus 2. Therefore, the specified number relating to the number of marks M and the size of the synchronizing area are determined in advance according to empirical rules that are obtained on the basis of or according to continuous form conveying ability of the image forming apparatus 1, experiments, simulations, etc. and plural marks M are formed on a continuous form P in such a manner that the mark width is changed according to the determined values.

In such a continuous form printing system, in the case where the control printed circuit board 15 gives a user of the apparatus information to the effect that the mark size reduction permission flag has turned on as information relating to mark width change of the mark M using the user interface of the image forming apparatus 1, the user of the apparatus can easily recognize timing that shape change of the mark M has been permitted. Such recognition may be used for determination, updating of determination results, etc. of the specified number relating to the number of marks M and the size of the synchronizing area.

For another example, in the continuous form printing system of FIG. 2, the first image forming apparatus 1*a* forms marks M on a continuous form P. A typical operation is such that the control printed circuit board 15 of the second image forming apparatus 1*b* outputs, to the first image forming apparatus 1*a*, information to the effect that mark width change of the mark M has been permitted as information relating to mark width change of the mark M and the first image forming apparatus 1*a* changes the mark width of marks M to be formed according to the received information.

With this operation, a result of the judgment, made in the second image forming apparatus 1*b*, as to whether to permit mark width change of the mark M is reflected in how the first image forming apparatus 1*a* forms marks M on the continuous form P. That is, the first image forming apparatus 1*a* does not change the mark width of the mark M until mark width change is permitted. The first image forming apparatus 1*a* changes the mark width of the mark M after a judgment is made that mark width change should be permitted.

Figure 9:
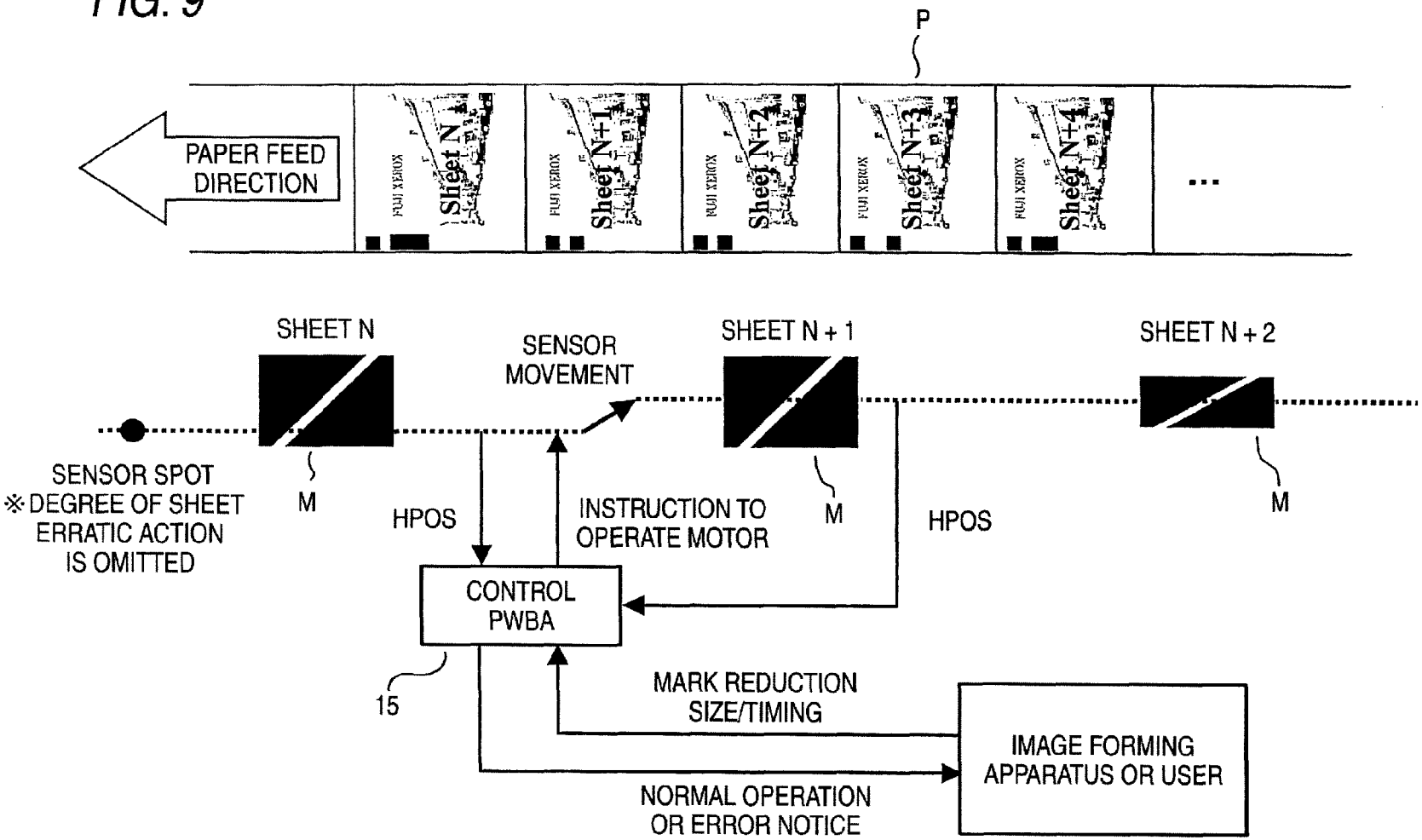
FIG. 9 illustrates a further example of an important part of the image forming apparatus according to the invention.

FIG. 9 illustrates a further example of an important part of the image forming apparatus 1 or 1*b*.

The example configuration of FIG. 9 is such that the optical sensor of the mark detecting unit 12 can be moved in the direction that crosses the continuous form conveying direction. More specifically, in this example configuration, the control printed circuit board 15 determines, as a relative positional relationship between the mark detecting unit 12 and a mark M on a continuous form P, a deviation between center positions in the main scanning direction of the effective detection range of the optical sensor of the mark detecting unit 12 and a mark M read by the optical sensor. On the basis of the determined deviation HPOS, the detection position of the optical sensor of the mark detecting unit 12 is moved so that the center positions in the main scanning direction of the effective detection range of the optical sensor of the mark detecting unit 12 and the mark M coincide with each other. Whether to permit mark width change of the mark M is judged on the basis of a detection result of the optical sensor of the mark detecting unit 12 thus moved.

Figure 10:
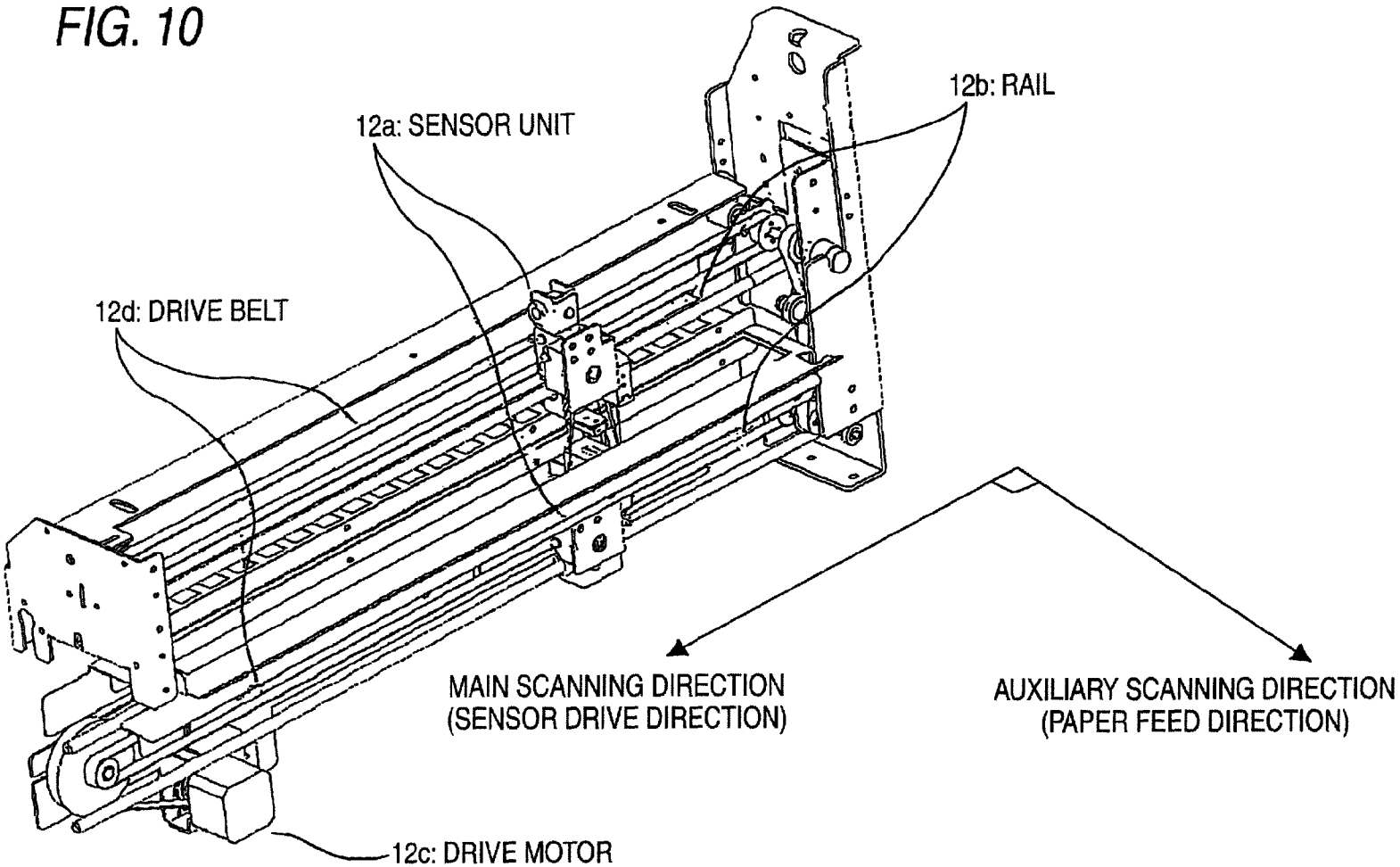
FIG. 10 illustrates a specific example of a sensor moving mechanism.

FIG. 10 illustrates a specific example of a sensor moving mechanism.

FIG. 10 shows an example sensor moving mechanism for moving the detection position of the optical sensor of the mark detecting unit 12 in the main scanning direction (i.e., the direction that is perpendicular to the conveying direction). More specifically, sensor units 12*a* which are mounted with the optical sensor is supported, so as to be movable in the main scanning direction, by rails 12*b* which extend in the main scanning direction. Drive belts 12*d* which are driven by a drive motor 12*c* such as a stepping motor are linked to the respective sensor units 12*a*. With the sensor moving mechanism having this configuration, in the mark detecting unit 12, the sensor units 12*a* are moved in the main scanning direction by a distance corresponding to a drive amount of the drive motor 12*c*.

Figure 11:
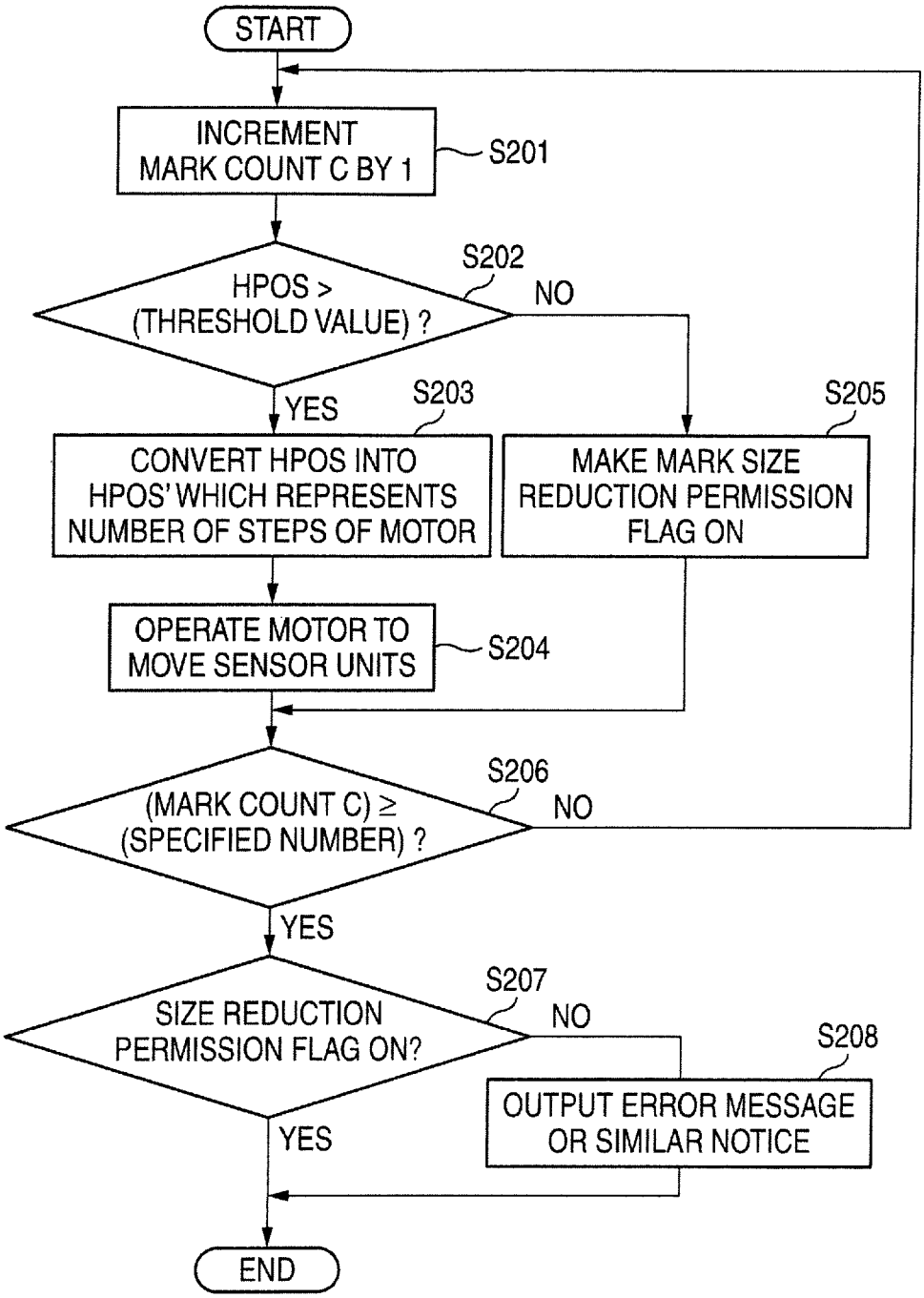
FIG. 11 is a flowchart of another specific example of the control process of the image forming apparatus according to the invention.

FIG. 11 is a flowchart of another specific control example of the process of the image forming apparatus according to an exemplary embodiment of the invention, that is, a control process with sensor movement.

As shown in FIG. 11, upon receiving a mark M detection signal from the mark detecting unit 12, at step S201 the control printed circuit board 15 starts counting the number of marks M. Every time a detection signal is received from the mark detecting unit 12, the control printed circuit board 15 performs signal processing on the detection signal and determines a deviation HPOS between center positions in the main scanning direction of the effective detection range of the optical sensor of the mark detecting unit 12 and the mark M detected by the optical sensor.

Upon determining a deviation HPOS, at step S202 the control printed circuit board 15 compares the determined deviation HPOS with a preset threshold value and judges whether the deviation HPOS is larger than the threshold value. The threshold value may be set in advance on the basis of empirical rules obtained by experiments etc. as a value above which the deviation HPOS require movement of the sensor units 12*a*, that is, adversely affects the detection of the marks M or may be set taking the performance (e.g., detection resolution) of the optical sensor into consideration to prevent erroneous detection of the optical sensor. For example, the threshold value may be set at 0.2 mm (absolute value).

If the deviation HPOS is larger than the threshold value, it is necessary to move the sensor units 12*a* in the main scanning direction. At step S203, the control printed circuit board 15 converts the deviation HPOS which is expressed in a unit that represents distance in the main scanning direction into a quantity HPOS' which represents a value corresponding to a drive amount of the drive motor 12*c* of the mark detecting unit 12, more specifically, the number of steps of the drive motor 12*c*. The conversion result is a correction amount HPOS' for the drive motor 12*c* that is necessary for setting the position of the sensor units 12*a* at the position of the marks M.

Upon determining the correction amount HPOS', the control printed circuit board 15 judges whether the correction amount HPOS' is a positive value. If the correction amount HPOS' is a positive value, at step S204 the control printed circuit board 15 causes the drive motor 12*c* to operate by the correction amount HPOS' by supplying operating pulses for clockwise rotation (as viewed from the output shaft side; normal rotation direction) to the drive motor 12*c* and thereby moves the sensor units 12*a* accordingly. If the correction amount HPOS' is not a positive value, at step S204 the control printed circuit board 15 causes the drive motor 12*c* to operate by the correction amount HPOS' by supplying operating pulses for counterclockwise rotation (as viewed from the output shaft side; reverse rotation direction) to the drive motor 12*c* and thereby moves the sensor units 12*a* accordingly.

On the other hand, if the deviation HPOS is not larger than the threshold value, at step S205 the control printed circuit board 15 does not move the sensor units 12*a* because the deviation HPOS is not so large as to adversely affect the detection of the marks M and hence it is not necessary to move the sensor units 12*a* in the main scanning direction. Since HPOS≦(threshold value), at step S205 the control printed circuit board 15 makes the mark size reduction permission flag on.

At step S206, the control printed circuit board 15 judges whether the count C of marks M is larger than or equal to a preset number (specified number). If the count C is not larger than or equal to the specified number, the process returns to step S201. On the other hand, if the count C is larger than or equal to the specified number, the process moves to step S207.

At step S207, the control printed circuit board 15 judges whether the mark size reduction permission flag is on. If the marksize reduction permission flag is on, the process is finished. On the other hand, if the mark size reduction permission flag is off, which means that the deviation HPOS is larger than the threshold value though the count C of marks M is larger than or equal to the specified number, at step S208 the control printed circuit board 15 judges that erratic action in an initial period after the start of conveyance of the continuous form P has not yet decreased sufficiently and outputs an error message or a similar notice. The error message or similar notice is typically output by using a user interface of the image forming apparatus 1 or 1*b*.

As a result of execution of the above control process, a position of a certain mark M in the main scanning direction and a position of the optical sensor of the mark detecting unit 12 in the main scanning direction are determined from a detection result of the mark M and the sensor units 12*a* which are mounted with the optical sensor are moved by a distance corresponding to the deviation between these positions. Therefore, when the next mark M is detected, the position deviation between the mark M and the optical sensor has already been corrected. That is, even if the effective detection range of the optical sensor is smaller than the size of the marks M, the marks M are prevented from going out of the effective detection range of the optical sensor by causing the optical sensor to follow the mark position by guiding the sensor units 12*a* so that the center of the effective detection range of the optical sensor coincides with the mark position.

In the image forming apparatus 1 or 1*b*, since the above-described control process is executed by the control printed circuit board 15, such shape change that the mark width is reduced can be permitted for the marks M which are formed on a continuous form P in the direction in which the continuous form P extends long continuously. In addition, since the optical sensor of the mark detecting unit 12 is caused to follow the mark position, the mark width can be reduced more than in the case that no such tracing is performed.

Although the preferred embodiments of the invention have been described above, the invention is not limited to those embodiments.

That is, the invention is not limited to the exemplary embodiments and various modifications are possible without departing from the spirit and scope of the invention.

What is claimed is:

1. A medium conveying apparatus comprising:

a conveying mechanism that conveys a recording medium that extends continuously in one direction, a conveying direction of the recording medium being the same as the one direction;

a detecting unit that detects a detection subject mark formed on the recording medium, wherein the detection subject mark is a rectangle having its longitudinal sides bifurcated by an oblique line;

a moving mechanism that moves the detecting unit in a main scanning direction that crosses the conveying direction, and a control section that outputs information relating to a mark width change of the detection subject mark, wherein a plurality of detection subject marks are formed on the recording medium in such a manner that their longitudinal sides are arranged in the one direction in which the recording medium extends continuously, and that the mark width of the rectangular-shaped detection subject marks, as measured in the main scanning direction, changes in subsequent detection subject marks on the recording medium as the recording medium conveys in the one direction.

2. The medium conveying apparatus according to claim 1, wherein the detection subject marks are formed in such a manner that the mark width decreases after a succession of a number of detection subject marks having the same mark width.

3. The medium conveying apparatus according to claim 1, wherein the detection subject marks are formed in such a manner that after a conveyance distance from a start of conveyance by the conveying mechanism has reached a preset value, the mark width is made smaller than before the conveyance distance has reached the value.

4. The medium conveying apparatus according to claim 1, wherein:

the medium conveying apparatus further comprises a mark forming unit that forms the detection subject marks on the recording medium; and the control section judges whether to permit mark width change of the detection subject marks and, if mark width change is to be permitted, outputs such information to the mark forming unit.

5. The medium conveying apparatus according to claim 1, wherein:

the medium conveying apparatus further comprises a positional relationship determining section that determines a relative positional relationship in the main scanning direction that crosses the conveying direction between the detecting unit and the detected detection subject mark on the basis of a detection result of the detecting unit; and the change of the mark width of the detection subject marks is performed based on a rule relating to the detection subject marks, the rule being used by the positional relationship determining section to determine a relative positional relationship.

6. The medium conveying apparatus according to claim 5, wherein the moving mechanism moves the detecting unit on the basis of the relative positional relationship determined by the positional relationship determining section.

7. The medium conveying apparatus according to claim 6, wherein:

the positional relationship determining section determines, as a relative positional relationship between the detecting unit and the detected detection subject mark, a deviation between a center position of a detection range of the detecting unit in the main scanning direction and a center position of the detected detection subject mark in the main scanning direction; and the moving means moves the detecting unit on the basis of the deviation determined by the positional relationship determining section so that a center position of subsequent detection subject marks in the main scanning direction coincides with the center position of the effective detection range of the detecting unit in the main scanning direction.

8. The medium conveying apparatus according to claim 7, wherein the recording medium is a sheet that extends long in one direction and has no feed holes.

9. An image forming apparatus comprising:

a conveying mechanism that conveys a recording medium which extends continuously in one direction, a conveying direction of the recording medium being the same as the one direction;

a detecting unit that detects a detection subject mark formed on the recording medium, wherein the detection subject mark is a rectangle having its longitudinal sides bifurcated by an oblique line;

an image forming unit that forms an image on the recording medium at a position that is determined on the basis of a detection result of the detecting unit;

a moving mechanism that moves the detecting unit in a main scanning direction that crosses the conveying direction, and a control section that outputs information relating to a mark width change of the detection subject mark, wherein a plurality of detection subject marks are formed on the recording medium in such a manner that their longitudinal sides are arranged in the one direction in which the recording medium extends continuously, and that the mark width of the rectangular-shaped detection subject marks, as measured in the main scanning direction, changes in subsequent detection subject marks on the recording medium as the recoding medium conveys in the one direction.

* * * * *